US011697854B2

(12) United States Patent
Mahrholz et al.

(10) Patent No.: US 11,697,854 B2
(45) Date of Patent: Jul. 11, 2023

(54) METHOD FOR CONTROLLING THE OPERATION OF A CONTINUOUSLY OR PERIODICALLY OPERATING CENTRIFUGE AND DEVICE FOR CONDUCTING THE METHOD

(71) Applicant: BMA Braunschweigische Maschinenbauanstalt AG, Braunschweig (DE)

(72) Inventors: Jens Mahrholz, Braunschweig (DE); Uwe Schwanke, Braunschweig (DE); Dirk Spangenberg, Badersleben (DE)

(73) Assignee: BMA Braunschweigische Maschinenbauanstalt AG, Braunschweig (DE)

( * ) Notice: Subject to any disclaimer, the term of this patent is extended or adjusted under 35 U.S.C. 154(b) by 477 days.

(21) Appl. No.: 16/817,980

(22) Filed: Mar. 13, 2020

(65) Prior Publication Data

US 2020/0299790 A1 Sep. 24, 2020

(30) Foreign Application Priority Data

Mar. 18, 2019 (DE) ..... 10 2019 106 842.8

(51) Int. Cl.
*C13B 30/06* (2011.01)
*B04B 11/02* (2006.01)
(Continued)

(52) U.S. Cl.
CPC ..... *C13B 30/06* (2013.01); *B04B 11/02* (2013.01); *B04B 11/04* (2013.01); *B04B 13/00* (2013.01)

(58) Field of Classification Search
CPC ..... C13B 30/06; B04B 11/02; B04B 11/04; B04B 3/00; B04B 13/00
See application file for complete search history.

(56) References Cited

U.S. PATENT DOCUMENTS 2,347,157 A * 4/1944 Roberts ..... C13B 30/06 210/781
3,238,063 A * 3/1966 Steele ..... B04B 3/00 210/781

(Continued)

FOREIGN PATENT DOCUMENTS

CN 106423589 2/2017
DE 32 28 074 2/1984

(Continued)

*Primary Examiner* — Charles Cooley
(74) *Attorney, Agent, or Firm* — Salter & Michaelson

(57) ABSTRACT

A method for controlling the operation of a continuously or periodically operating centrifuge can be employed in the sugar industry for separating crystalline carbohydrates or sugar alcohols from a crystal suspension called a magma or a mother liquor. The magma has a varying content of fine grain that is dependent on the properties of the pretreatment and of the raw material. Variable control values are provided in a control device of the centrifuge. One or plurality of sensors are provided that carry out the measurements in electromagnetic, optical, acoustic, and/or conductive ways. These measurements that are conducted serve for determining the fine grain fraction of the magma. The measurements are supplied as measurement signals to the control device of the centrifuge. The control device automatically analyzes the measurement signals supplied to it and evaluates them with respect to the fine grain content of the magma. The control device changes the variable control values of the centrifuge as a function of this evaluation.

25 Claims, 2 Drawing Sheets

(51) Int. Cl.
*B04B 11/04* (2006.01)
*B04B 13/00* (2006.01)

(56) References Cited

U.S. PATENT DOCUMENTS

| | | | | |
|---|---|---|---|---|
| 4,257,879 | A * | 3/1981 | Bogenschneider | B03B 9/005 209/233 |
| 4,475,897 | A | 10/1984 | Bradtmoller | |
| 5,104,453 | A * | 4/1992 | Kappler | B04B 13/00 127/63 |
| 7,229,549 | B2 * | 6/2007 | Grimwood | B04B 13/00 210/85 |
| 8,337,378 | B2 | 12/2012 | Chan | |
| 10,513,746 | B2 * | 12/2019 | Myers | B04B 3/00 |
| 2009/0045147 | A1 * | 2/2009 | Schmid | B04B 15/12 210/772 |
| 2015/0290662 | A1 * | 10/2015 | Lehnberger | B04B 7/02 494/37 |
| 2019/0024196 | A1 * | 1/2019 | Mahrholz | C13B 30/027 |
| 2020/0299790 | A1 * | 9/2020 | Mahrholz | B04B 13/00 |

FOREIGN PATENT DOCUMENTS

| | | |
|---|---|---|
| DE | 38 22 225 | 7/1989 |
| DE | 10 2016 101 217 | 7/2017 |
| EP | 0 348 639 | 1/1990 |
| EP | 1 405 674 | 7/2004 |
| EP | 3 085 452 | 10/2016 |
| WO | 2008/058340 | 5/2008 |

* cited by examiner

METHOD FOR CONTROLLING THE OPERATION OF A CONTINUOUSLY OR PERIODICALLY OPERATING CENTRIFUGE AND DEVICE FOR CONDUCTING THE METHOD

FIELD OF THE INVENTION

The invention relates to a method for controlling the operation of a continuously or periodically operating centrifuge that can be used in the sugar industry for separating crystalline carbohydrates or sugar alcohols from a suspension of crystals called magma, composed of syrup and crystals, wherein the magma has a varying content of fine grain dependent on the properties of the pretreatment and of the raw material. The method is based on the variable control values in a control device of the centrifuge. The invention further relates to a device for conducting the method.

BACKGROUND OF THE INVENTION

Periodically and continuously operating centrifuges, typically suspended centrifuges or pusher centrifuges are employed in the sugar industry. The magma is processed by spinning in these centrifuges. The most varied constituents are contained in this magma; among other constituents, so-called fine grain can be contained therein in large or small amounts. Magma containing fine grain is considered to be magma of lower quality and causes certain difficulties during processing in centrifuges.

In practice, it appears that the centrifuges are operated with control values from a control device, wherein these control values include, in particular, the rotational speed, but also the layer thickness of the crystal layer building up on the centrifuge wall, or the so-called water blanket that is composed of washing fluid in the interior of the centrifuge.

The operation of the sugar centrifuge is monitored by a machine operator who can undertake specific readjustments manually. In order to be able to perform these, however, the machine operator must be experienced and know that the magma has certain properties.

Purely optically, this operation is already prone to error since the machine operator can make erroneous evaluations, or in the case of a change in the magma properties, this change may not be recognized in a timely manner.

To improve on this, therefore, there is oral communication in the sugar house between the centrifuge station, on the one hand, and a cooking station, on the other hand. If fine grain should have arisen in the cooking equipment, the machine operator must then react contemporaneously to the modified situation in the centrifuge and adjust the control values. Apart from the fact that suboptimal results are obtained thereby, in fact risky operating conditions may occur in the individual case that can only be avoided manually, for example, an abrupt upswing due to imbalance, with a swirling liquid wave in the drum of the centrifuge.

The effects of these dangerous operating states, however, for the most part are recognized too late. Often, only a complete shutdown of the operation of the centrifuge will help, if smaller imbalances or a swinging are recognized; in the most unfavorable case, a complete breakdown of such a machine may in fact occur. Improvements in centrifuges of this type for the sugar industry or also for other fields have been worked on for several decades. Basically, one could operate with sensors and other optimizing elements, such as are known, for example, from DE 32 28 074 C2, WO 2008/058340 A1, and CN 106423589 A.

These centrifuges are operated with a turbidity sensor. The object of the turbidity sensors employed therein is information on the effectiveness of the separation of solids from a mixture of substances or on the extent of a layer buildup in the centrifuge, in order to obtain as large a mass flow as possible with a purity that is as high as possible of the liquid phase or the mother liquor at the outlet of the centrifuge. Also, a blockage of the centrifuge should be avoided. This has nothing to do with the present problems. Approaches for solving problems that are caused by too high a content of fine grain are not known from this prior art.

The same holds true for a conductivity sensor that is known from EP 1 405 674 A2 and can be arranged on a spray casing of a centrifuge. The quality of the mother liquor with respect to the ion concentration will be evaluated with this conductivity sensor in order to determine a switch point for separating the run-off.

Another proposal is known from EP 0 348 639 A2. The separating out of liquid fractions and fine grain fractions from a sugar suspension shall be improved thereby. For this purpose, the area density of the filter cake that has been formed in the centrifuge is measured at times or continuously. From this measurement, conclusions are drawn on the condition of the filter cake, and supported by this, the quantity of water to be introduced in the washing phase is determined. In this case, there is no thought of the control and monitoring of the operation of the sugar centrifuge itself. Such a measurement instrument would also not be able to do this.

It would be desirable if there were a possibility for facilitating or supporting the previously used manual control and monitoring of the operation of sugar centrifuges, one that could also take into consideration the appearance of fine grain content in suitable form.

The object of the invention is thus to present a proposal for a method and a device, with which an improved consideration of the varying fine grain content of the magma in a centrifuge drum can be followed not just manually.

SUMMARY OF THE INVENTION

This object is achieved by a generic method by means of the invention, in that one or a plurality of sensors are provided, which conduct measurements in electromagnetic, optical, acoustic, and/or conductive ways, in that these measurements that are conducted serve for determining the fine grain fraction of the magma, in that the measurements are supplied as measurement signals to the control device of the centrifuge, in that the control device automatically analyzes the measurement signals supplied to it and evaluates these with respect to the fine grain content of the magma, and in that the control device adjusts the variable control values of the centrifuge as a function of this evaluation.

Further, the invention relates to a device for conducting the method.

With a method of this type and a device of this type, the stated object can be achieved, and moreover, a number of additional advantages are also achieved, which is surprising to the person skilled in the art.

Namely, the invention makes possible an online quality monitoring of the sugar magma in sugar centrifuges with respect to the fine grain content.

This possibility is created by the clever arrangement of one or a plurality of sensors that establish measurement signals in a targeted manner with respect to the fine grain content and pass them on to a control device with which the control values of the sugar centrifuge can be adjusted.

This means that a considerable increase in the safety of the equipment and the method will be achieved, since it is no longer necessary to leave this quality judgement to the communication between the machine operator and the cooking station in the sugar house. The machine operator can thus devote himself to other tasks, and in the cooking station, attention need not be paid to such communication.

The operation of the centrifuge in the sugar industry will be overall more stable, less hazardous, and more fail-safe thanks to the invention. The number and the duration of shutdown times will be reduced and the operation of the centrifuge overall will be more economical thereby.

Moreover, the conducting of the method can also be optimized, since very small contents of fine grain in the magma can also be considered in order to achieve a regulation of the control device by way of the measurement signals.

In particular, however, a breakdown of the equipment due to handling by the machine operator that is too late or perhaps even accidentally inappropriate can be avoided, and in the case of low-quality magma, by taking countermeasures that are as optimal as possible, the consequence of an emergency shutdown can be avoided and any delay in the batch run-off can be reduced.

Fail-safe control routines in the control device or the entire machine control can be implemented from the outset, with which suitable and predetermined countermeasures can be initiated in each case.

The invention can be employed both in continuously as well as in periodically operating centrifuges.

Specifically, in different embodiments of the invention, different forms of sensors can be used, each of which, however, is designed especially for measurement signals that serve for determining the fine grain content either directly, or the absence of fine grain can be concluded indirectly based on an adversely affected separation behavior of the mother liquor from the magma.

The preferred or at least possible types of sensors for use in the present invention and for achieving the object also depend on the measurement position at which they are utilized.

If the measurement position is found before the centrifuge drum and the system property to be measured is the fine grain fraction, then a turbidity sensor that performs a measurement based on transmittance or reflectance is a particularly preferred sensor. Possible sensors for this measurement position, for example, are also sensors of the VIS (visual) type; for example, they operate according to the focused beam reflectance measurement (FBRM) principle, or Koch microscopes. Also possible are ultrasonic sensors that operate by means of transmission or reflection.

If the measurement position is provided in the centrifuge drum and the measured system property refers to the color, constituents, or thickness of the crystal cake, then preferably, a sensor of the VIS (visual) type will be used, in this case, a spectrophotometer sensor or a laser, or even a radar sensor operating by means of reflectance. In addition, possible sensors are UV sensors, IR/Raman sensors, microwave sensors, or ultrasonic sensors that operate by transmittance and reflectance.

If the measurement position is found after the centrifuge drum, viewed in the direction of the method, thus typically at the spray casing, and the system property to be measured is the color, constituents, conductivity, or the structure-borne sound of the run-off, then preferred sensors in turn are VIS (visual) sensors, in particular spectrophotometer sensors, or conductivity sensors that operate with a 2-electrode or 4-electrode measurement technique. Possible sensors for this measurement position are also UV sensors, IR/Raman sensors, for example ATR-FTIR, microwave sensors, sound sensors that operate with sound conduction, or turbidity sensors that operate on the basis of transmittance or reflectance.

Sensors that detect the magma properties by measurement technology can be provided outside the centrifuge just before the magma reaches the centrifuge.

Other redundantly operating sensors can measure in the centrifuge drum and are localized, as expected, on the centrifuge cover or in the centrifuge drum. Finally, there are still more redundantly operating sensors on the spray casing of the centrifuge.

All these redundantly operating sensors can detect changes in the build-up of the crystal cake and of the crystal color or properties of the separated mother liquor, and are processed as variable measurement values in the control device of the centrifuge, which has not previously been utilized up to now in centrifuge processes in the sugar industry.

The $1^{st}$ measurement position, thus before the centrifuge drum has the greatest significance in control technology, since the quality of the magma will be evaluated with respect to the fine grain fraction even before the magma reaches into the centrifuge. The $2^{nd}$ and $3^{rd}$ measurement positions, thus in the centrifuge drum or after the centrifuge drum (typically on the spray casing) are connected downstream and following one another chronologically; however, they are always still suitable for controlling critical centrifuge conditions. The serve as redundant measurement positions. The sensors of the $1^{st}$ measurement position can operate alone, but they may also be complemented by those of the $2^{nd}$ measurement position and/or the $3^{rd}$ measurement position. This may be helpful for the rare case when the sensors of the $1^{st}$ measurement position experience a malfunction. The sensors of the $2^{nd}$ and $3^{rd}$ measurement positions are to be understood as redundant to the $1^{st}$ measurement position. These sensors are present in general for tasks of measurement technology (e.g. control of the crystal layer thickness, water blanket, separation of run-off) other than the function described here of monitoring the fine grain. Nevertheless, however, they can also be drawn on for this purpose.

It is particularly preferred if the measurement signals serving for determining the fine grain content of the magma are directly detected, or if the measurement signals serving for the determination of the fine grain content of the magma are detected as the first time derivative, or if measurement signals serving for determining the fine grain content of the magma are detected as the second time derivative, or if the detection is made up of a combination of two or more of these alternatives.

As has been demonstrated in tests, a number of measurement signals in the slurry distributor turned on before the centrifuge do not change abruptly due to intermixing processes and a specific fine grain residence time. It has been shown that they increase in practice at a specific rate. This has the consequence that, e.g., in addition to a turbidity fixed value, the first or the second derivative of the measurement signal can also be used as a control value for the turbidity depending on the time and is interesting. The same thing is true analogously for the optionally used other redundant sensors.

As has been demonstrated in tests, the magma quality can be followed in real time. Fine grain can be recognized at an early time in the magma and information on the fine grain content is found.

In such a configuration as described, with a plurality of sensors, the turbidity sensor can be used most preferably in order to recognize a change in the fine grain content in the magma even outside the centrifuge. A color sensor, laser sensor, or radar sensor recognizes such an increase in the fine grain content only when the magma reaches the centrifuge and a changed crystal cake indicating the fine grain content is built up.

The preferred use of a conductivity sensor or a spectrophotometer sensor on the spray casing can serve in this case as chronologically last. The latter react as the last sensors, but of course, still during the filling phase or at the beginning of the acceleration phase.

In this case, the conductivity can be determined as a measurement signal, in particular, by means of a planar two-pole or four-pole electrode with predefined electrode geometry. Alternatively or additionally, the measurement used for determining the measurement signal can be based on an interaction between electromagnetic radiation and the mother liquor of the magma, and the measurement signal can be detected as a visual signal in the L*a*b or RGB color space.

Various automatic adjustments of the control values can be performed in the control device. Included also is the adjustment of the layer covering, water blanket, rotational speed, and also the conducting of intermediate centrifuging operations.

Various sensors are suitable for extracting the measurement signals, and with such sensors, the centrifuge station can be protected overall from the detrimental influence of magma containing fine grain.

Therefore, for example, in the slurry distributor upstream to the centrifuge, a turbidity sensor can be implemented, which measures reflectance and/or transmittance.

Sensors that detect the measurement signal as an electromagnetic or acoustic reflectance signal are suitable in the centrifuge drum or on the centrifuge cover. For example, in the form of a distance signal by means of radar, laser, or ultrasonic sensor, or as a dry-matter signal by means of microwaves, or as a color signal by means of a spectrophotometer sensor. In addition, the UV and IR ranges may also be utilized.

For this purpose, the sensor or the sensors can be aligned on the body of the drum or on a crystal cake of the magma being built up thereon. For example, the alignment can be made at an angle of less than or equal to 90° on the body of the drum or on the crystal cake of the magma being built up thereon.

A conductivity sensor, a spectrophotometer sensor, a UV or IR sensor, which generates a time-dependent measurement signal from the run-off film that is able to indirectly determine the presence of fine grain can be introduced on the spray casing of the centrifuge.

A particularly preferred method is characterized in that a regulation established in advance is provided for the control routines, as follows:

filling the centrifuge with more than 50% and less than 70% of the maximum filling load; adjusting the rotational speed of the centrifuge during filling to 150 to 200 rpm;

omitting the conventional syrup covering; after filling, increasing the rotational speed with adjustable acceleration curves dependent on the time course and/or dependent on the viscosity and/or dependent on the fine grain content of the magma up to a predetermined or defined rotational speed; adding a first water blanket (WB) or optionally a plurality of water blankets staggered in time during this increase in the rotational speed; optional conducting of an intermediate centrifuging step;

in this case, adding another water blanket (WB): increasing the rotational speed to a predetermined or defined rotational speed; keeping this rotational speed constant for approximately 5 to 40 seconds, in particular for approximately 10 to 30 seconds; throttling the rotational speed in the case of an established imbalance, subsequent repeated increasing of the rotational speed and, optionally, several repetitions of this step; braking the centrifuge drum; emptying the centrifuge drum; and conducting a screen washing.

In this way, an increase in the rotational speed is possible, which can be variably configured relative to its time course. The increase in the rotational speed thus, for example, can be made dependent on the slope of the curve belonging thereto.

Thanks to this variability, for example, one can react to a different viscosity or to a currently determined fine grain content of the magma.

Simultaneously, with a flatter course of the measured curves determined therefrom, unwanted peaks in the current load of the centrifuge drum also can be avoided.

In addition, the level of each of the actuated quasi ramp-shaped maximum values for rotational speed can be configured in a variable manner.

Of course, it is also possible to operate in a method of this type with linear increases in the rotational speed. This also has advantages due to a simpler design for specific cases of application.

DESCRIPTION OF THE DRAWINGS

Additional preferred features of the invention are characterized in the appended description of the figures and the dependent claims.

Embodiment examples of the invention are explained in more detail in the following on the basis of the drawing. Herein.

DETAILED DESCRIPTION

Figure 1:
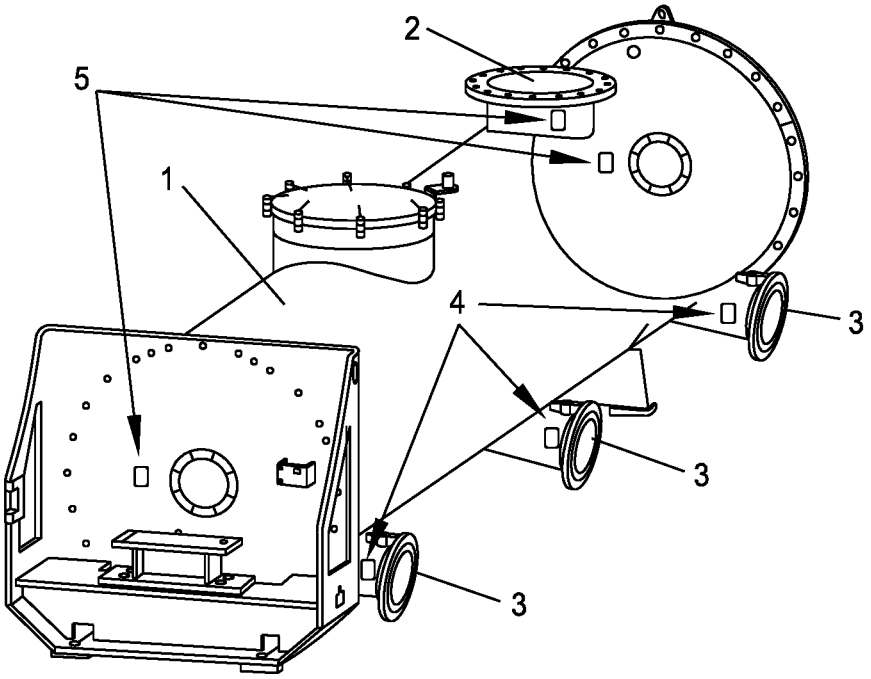
FIG. 1 shows a schematic arrangement of different elements used in the field of a sugar centrifuge according to different embodiments of the invention.

Different elements in the surroundings of a sugar centrifuge are indicated in FIG. 1. The centrifuge itself is not shown in order to make clearer the details of the other elements.

Therefore, one recognizes a slurry distributor 1 with an associated trough, wherein agitator shaft and motor are omitted. A connection piece 2, by way of which the product or the raw material is supplied, leads into the slurry distributor 1.

Additional connection pieces 3 are provided, by which the quantity in the slurry distributor to be further processed is discharged to the centrifuge.

Figure 2:
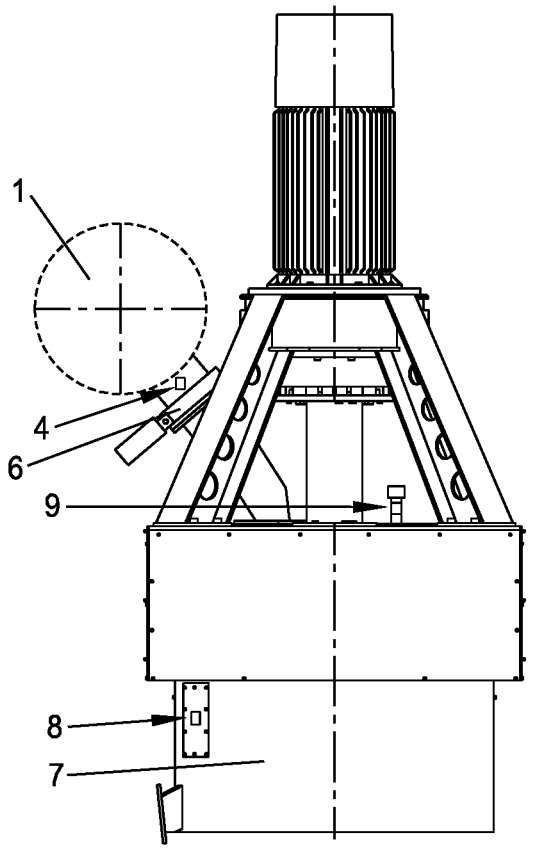
FIG. 2 shows a lateral view of a sugar centrifuge.

Turbidity sensors 4 are indicated on the connection pieces 3 or at least on some of these connection pieces 3. Therefore, these turbidity sensors are found between the run-off from the slurry distributor and a butterfly valve 6 (can be better seen in FIG. 2) on the centrifuge. A measurement signal can now be generated by means of these turbidity sensors 4, with which conclusions can be made on the quality of the magma in the control device (not shown).

This turbidity sensor 4 is continually wetted with magma, but it should not become encrusted. Therefore, a mounted position at the specified place on the connection piece 3 has been shown to be positive in tests.

Not shown, but conceivable would be additionally providing a rinsing line or cleaning fitting for the turbidity sensors 4.

The turbidity sensors 4 could also be accommodated at alternative mounting positions, roughly at the front or back of the slurry distributor 1, which is indicated by the reference number 5.

Possible also is the introduction of the turbidity sensors 4 in the inlet for the product on the connection piece 2. This embodiment has the advantage that a plurality of centrifuges or machines could be correspondingly provided with connection to a turbidity sensor equally and can secure the advantages according to the invention.

The turbidity sensor in this case is also better exposed to the fluid dynamic processes and any encrustation is improbable from the outset. Also, in this measurement position at the inlet with the connection piece 2, a warning time of approximately 12 minutes or 4 batches is sufficiently short, with which the arrival of possible fine grain in the centrifuge is announced and is fully effective, in that there is sufficient fine grain content added to the centrifuge to provoke an upswing. The centrifuges can also still be considered to be protected in such an embodiment.

Alongside or in addition to the turbidity sensor, other forms of sensors can also be employed, for example acoustic sensors, in particular ultrasonic sensors. Also conceivable are imaging methods and the use of Koch microscopes or video microscopes. Of course, these imaging methods are more expensive and more complex, and are usually less compact when mounted in a constricted structural space on the slurry distributor.

Possible also is the use of optical lasers according to the focused beam reflectance measurement (FBRM) principle, which are very expensive, of course, but which supply good measurement results.

In addition to the turbidity sensor 4, a redundant system of sensors in the drum or on the cover of the centrifuge and on the spray casing of the centrifuge can provide additional safety. These redundant systems of sensors react to changes in the build-up and the color of the crystal cake or to changes in the properties of the separated mother liquor, in each case when compared to conventional data as are found in a standard operation of a centrifuge not embodied according to the invention.

In this case, as indicated by reference number 9, fine grain can be recognized optically in a centrifuge drum by an absent or delayed color change. Recognizing fine grain due to the absence of a change in the layer covering or a delayed change is produced by means of radar, laser, or ultrasonic distance measurement. Unusually slow changes in the composition of the magma in the centrifuge drum can be detected by UV, IR/Raman and microwave signals and may also indicate fine grain as well as the reduced or suppressed separation of the mother liquor associated therewith.

Fine grain can also be recognized optically by an absent or delayed change in color at the spray casing 7 of the centrifuge and at the position 8, whereas with a sensor for conductivity, an absent or a delayed conductivity signal is used for recognizing fine grain. No changes or unusually slow changes in the composition of the run-off can be detected by changed UV and IR/Raman signals and may also indicate fine grain as well as the reduced or suppressed separation of the mother liquor associated therewith.

The measurement signals of all sensors employed can be continuously detected and evaluated by means of memory-programmable control (MPC). Each time depending on divergence, intensity and fine grain fraction, corresponding fail-safe control routines can be initiated.

Figure 3:
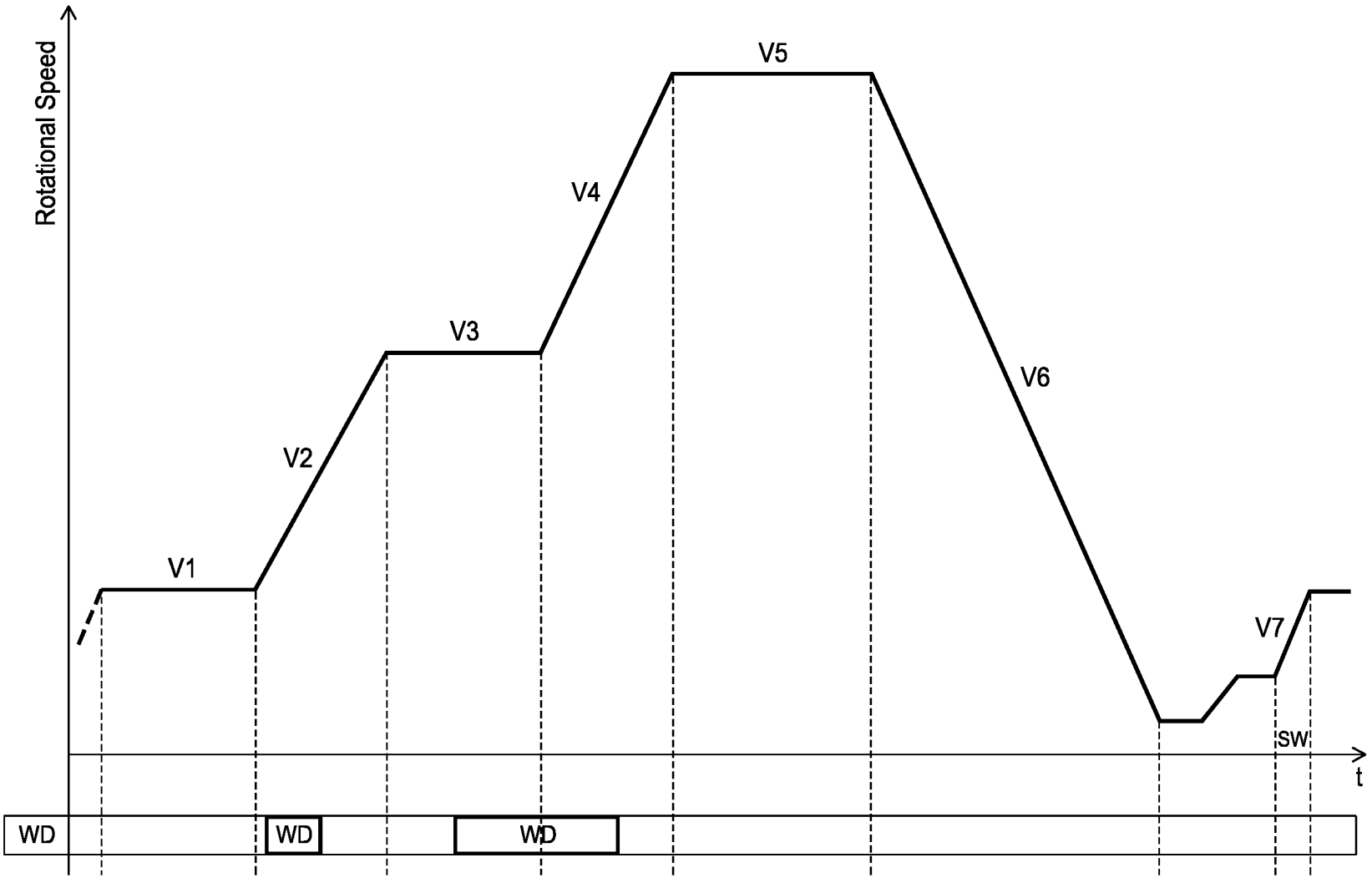
FIG. 3 shows a schematic overview relating to a method run in a sugar centrifuge.

A method could appear overall as that shown schematically in FIG. 3 on the basis of an example.

The time t is plotted toward the right and the rotational speed in revolutions per minute is plotted toward the top. The presentation, of course, is not shown at correct scale.

Below the time axis is additionally plotted the phase in which a water blanket WB is applied, and finally the method step in which a screen washing is carried out.

In a first step V1, the filling of the centrifuge is conducted. Unlike the case in conventional processes, the centrifuge is only filled to approximately 60% to 70%, but at least to 50%. With a smaller filling, an imbalance could arise. The rotational speed of the centrifuge amounts to approximately 150 to 200 rpm during the filling process.

Unlike in the conventional case, a syrup covering is not provided from the outset and thus is turned off. It would only intensify problems that arise due to the fine grain content.

In a second step V2, the rotational speed is increased and a first water blanket WB is supplied. The rotational speed is increased linearly up to the range of approximately 700 rpm, since otherwise too great a compacting of the crystal cake would occur.

Simultaneously, in about the middle of this step a first water blanket WB is added in order to dissolve the fine grain contained and to partially dilute or replace the mother liquor before the crystal cake is added.

This procedure can take place controlled by rotational speed or by time. The supplying of the water blanket WB will be carried out preferably 1 to 5 seconds after the end of the filling process; the duration of the water blanket is 1 second to 3 seconds.

In a third step V3, an intermediate centrifuging and a second water blanket WB are carried out. The rotational speed is still maintained for approximately 10 seconds at 700 rpm. At the same time, at the end of this step, a second water blanket is supplied in order to completely replace the mother liquor.

The water blanket WB can be supplied automatically, for example controlled by an optical sensor, wherein a measurement of color change is conducted.

The duration of the second water blanket WB is set at a maximum that corresponds to the normal operation with a radar sensor or also a laser sensor and a 100% drum filling. In this case, 100% corresponds to approximately 12 seconds to 18 seconds.

The layering of the water blanket should lie one-third to one-half in the next acceleration phase.

In a fourth step V4, the rotational speed is increased linearly up to 1080 rpm.

In a fifth step V5, the rotational speed is kept constant at 1080 rpm. The standard spin duration in this step is 20 seconds to 30 seconds. As long as an imbalance does not occur, the spin duration can be prolonged by 10% to 20% in order to reduce the greater moisture of the crystal cake.

Depending on whether an imbalance occurs, which is determined by an oscillation measurement device, the rotational speed of the centrifuge is regulated downward under certain conditions and subsequently increased again. A multi-step centrifuging procedure results therefrom, which can be conducted approximately two or three times.

Since the crystal cake is newly aligned during braking V6, it has been found in tests that the water can better penetrate the crystal cake in multi-step centrifuging. In this way, a quieter, stable run occurs.

The rotational speed lies in the range of the intermediate centrifuging and of the centrifuging.

The intrinsic resonance of the machine should be considered. In centrifuges commonly found on the market, it lies somewhat below 700 rpm. Beyond this rotational speed in the region of the intrinsic resonance, one should relatively quickly walk away from it.

Further steps correspond to the standard process. Therefore, in conclusion to the braking V6, another method step of emptying V7 is provided, and subsequently thereto a screen washing SW.

LIST OF REFERENCE CHARACTERS

1. Slurry distributor
2. Connection piece for the product inlet
3. Connection piece to the centrifuge
4. Turbidity sensor
5. Alternative position of the turbidity sensors
6. Butterfly valve on the centrifuge
7. Spray casing of the centrifuge
8. Conductivity sensor or optical sensor
9. Laser sensor or optical sensor
V1 First method step: Filling
V2 Second method step: $1^{st}$ acceleration
V3 Third method step: Intermediate centrifuging
V4 Fourth method step: $2^{nd}$ acceleration
V5 Fifth method step: Centrifuging
V6 Sixth method step: Braking
V7 Seventh method step: Emptying
SW Screen washing
WB Water blanket

What is claimed is:

1. A method for controlling the operation of a continuously or periodically operating centrifuge,
which is employed in the sugar industry for separating crystalline carbohydrates or sugar alcohols from a crystal suspension called a magma or a mother liquor,
wherein the magma has a varying content of fine grain that is dependent on the properties of the pretreatment and of the raw material,
with variable control values in a control device of the centrifuge,
is hereby characterized
in that one or a plurality of sensors are provided that carry out the measurements in electromagnetic, optical, acoustic, and/or conductive ways,
in that these measurements that are conducted serve for determining the fine grain fraction of the magma,
in that the measurements are supplied as measurement signals to the control device of the centrifuge,
in that the control device automatically analyzes the measurement signals supplied to it and evaluates them with respect to the fine grain content of the magma, and
in that the control device adjusts the variable control values of the centrifuge as a function of this evaluation,
in that a regulation established in advance in the control routines is provided as follows:
filling the centrifuge with more than 50% and less than 70% of a maximum filling load and at a predetermined first constant rotational speed (step V1);
after filling the centrifuge, increasing the rotational speed (step V2) to a second constant rotational speed (step V3);
maintaining the second constant rotational speed (step V3) for a predetermined period of time; and
after maintaining the second constant rotational speed (step V3), increasing the rotational speed (step V4) to a third constant rotational speed (step V5).

2. The method according to claim 1,
further characterized
in that the measurement signals serving for determining the fine grain content of the magma are detected directly, or
in that the measurement signals serving for determining the fine grain content of the magma are detected as the first time derivative, or
in that the measurement signals serving for determining the fine grain content of the magma are detected as the second time derivative, or
in that the detection is composed of a combination of a plurality of these alternatives.

3. The method according to claim 1,
further characterized
in that the measurement signal or one of the measurement signals is generated by interaction between sound waves and/or electromagnetic radiation and/or optical radiation and the elements of the magma, and
in that, ultrasound-based, imaging, laser-based and/or scattered light-based methods are drawn on for extracting the measurement signal or the measurement signals.

4. The method according to claim 3,
further characterized
in that, in the case of using a scattered light-based method, a turbidity signal is extracted, which is detected as a transmittance signal and/or as a reflectance signal.

5. The method according to claim 4,
further characterized
in that a sensor or the sensor generating the measurement signal is arranged directly in a crystallizer at a bubble-free measurement position or at a measurement position along the transport path of the magma to the centrifuge.

6. The method according to claim 5,
further characterized
in that, in the case of levels of measurement signals that change over time and/or a changing rate of the measurement signals and/or a changing rate of the signaling speed outside of a tolerance region, control routines provided in the control device are triggered.

7. The method according to claim 1,
further characterized
in that the measurements for the measurement signal to be extracted are created by an interaction between electromagnetic radiation and the crystals of the magma or the magma itself, and
in that the measurement signal is detected as a reflecting signal in the form of a distance signal by means of a laser sensor or radar sensor or ultrasonic sensor, or as a spectrophotometer signal by means of a spectrophotometer sensor, or as a dry-matter signal by means of microwaves.

8. The method according to claim 7,
further characterized in that the sensor is found inside and/or outside the drum of the centrifuge and is aligned on the body of the drum and a crystal cake of the magma that is being built up thereon.

9. The method according to claim 7,
further characterized
in that when the level of a measurement signal over time exceeds or goes below a predefined threshold value, control routines established for this purpose are triggered, in particular during the filling and acceleration process.

10. The method according to claim 1,
further characterized
in that the measurements for establishing the measurement signal are extracted by means of an interaction between electromagnetic and/or acoustic fields and the mother liquor of the magma, and
in that, the conductivity is determined as a measurement signal by means of a planar two-pole or four-pole electrode with predefined electrode geometry.

11. The method according to claim 10,
further characterized
in that the sensor or one of the sensors extracting the measurement signal is arranged flush in a spray casing of the centrifuge, in the lower third of the spray casing.

12. The method according to claim 10,
further characterized
in that when the level of a measurement signal over time exceeds or goes below a predefined threshold value, control routines established for this purpose are triggered during the filling and acceleration process.

13. The method according to claim 1,
further characterized
in that the sensors for conducting the measurements for extracting the measurement signals in the course of flow of the magma are arranged before the centrifuge, in the drum and/or in the cover of the centrifuge and in the spray casing of the centrifuge individually or in redundant combinations of two or three.

14. The method according to claim 1,
further characterized
in that the control routines contain a reduction of the inflow of magma, a reduction in the building up of the layer thickness, and/or a reduction or an increase in the rotational speed of the spinning centrifuge; moreover, there is also a regulating of the water blanket.

15. The method according to claim 1 wherein, after filling the centrifuge, linearly increasing the rotational speed (step V2) to a constant second rotational speed (step V3).

16. The method according to claim 15, further characterized by adding a first water blanket during the linear increase in the rotational speed (step V2).

17. The method according to claim 16, further characterized by adding a second water blanket during the second constant rotational speed (step V3).

18. The method according to claim 16, further characterized by adding a second water washing during the second constant rotational speed (step V3).

19. The method according to claim 15, further characterized by adding a first water washing during the linear increase in the rotational speed (step V2).

20. The method according to claim 1,
further characterized by,
after increasing the rotational speed to the third constant rotational speed (step V5);
throttling the rotational speed in the case of an established imbalance;
subsequent repeated increasing of the rotational speed and, optionally, several repetitions of this step;
braking the centrifuge drum;
emptying the centrifuge drum; and
conducting a screen washing.

21. The method according to claim 1, further characterized by, after maintaining the third constant rotational speed for a predetermined period of time, decreasing the rotational speed (step V6), followed by an emptying step (step V7).

22. A method for controlling the operation of a continuously or periodically operating centrifuge,
which is employed in the sugar industry for separating crystalline carbohydrates or sugar alcohols from a crystal suspension called a magma or a mother liquor,
wherein the magma has a varying content of fine grain that is dependent on the properties of the pretreatment and of the raw material,
with variable control values in a control device of the centrifuge,
is hereby characterized
in that one or a plurality of sensors are provided that carry out the measurements in electromagnetic, optical, acoustic, and/or conductive ways,
in that these measurements that are conducted serve for determining the fine grain fraction of the magma,
in that the measurements are supplied as measurement signals to the control device of the centrifuge,
in that the control device automatically analyzes the measurement signals supplied to it and evaluates them with respect to the fine grain content of the magma, and
in that the control device adjusts the variable control values of the centrifuge as a function of this evaluation,
in that the measurements for establishing the measurement signal are extracted by means of an interaction between electromagnetic and/or acoustic fields and the mother liquor of the magma,
in that the conductivity is determined as a measurement signal by means of a planar two-pole or four-pole electrode with predefined electrode geometry,
in that the measurement used for establishing the measurement signal utilizes an interaction between electromagnetic radiation and the mother liquor of the magma, and
in that the measurement signal is detected as a visual signal in the L*a*b or RGB color space or as a UV or IR/Raman or acoustic signal.

23. A method for controlling the operation of a continuously or periodically operating centrifuge,
which is employed in the sugar industry for separating crystalline carbohydrates or sugar alcohols from a crystal suspension called a magma or a mother liquor,
wherein the magma has a varying content of fine grain that is dependent on the properties of the pretreatment and of the raw material,
with variable control values in a control device of the centrifuge,
is hereby characterized
in that one or a plurality of sensors are provided that carry out the measurements in electromagnetic, optical, acoustic, and/or conductive ways,
in that these measurements that are conducted serve for determining the fine grain fraction of the magma,
in that the measurements are supplied as measurement signals to the control device of the centrifuge,
in that the control device automatically analyzes the measurement signals supplied to it and evaluates them with respect to the fine grain content of the magma, and in that the control device adjusts the variable control values of the centrifuge as a function of this evaluation, in that the sensors for conducting the measurements for extracting the measurement signals in the course of flow of the magma are arranged before the centrifuge, in the drum and/or in the cover of the centrifuge and in the spray casing of the centrifuge individually or in redundant combinations of two or three, in that a measurement signal is determined as a turbidity signal in front of a butterfly valve of the centrifuge, and in that another sensor is provided as a laser sensor or radar sensor or spectrophotometer sensor in the drum or on the cover of the centrifuge, and a third sensor is provided for the conductivity or the color in the spray casing of the centrifuge, and in that the sensor for the laser signal or the radar signal or the color signal and the sensor for the conductivity or the color are used as redundant secondary or tertiary measurement signals with a stepped, slight time delay.

24. A method for controlling the operation of a continuously or periodically operating centrifuge, which is employed in the sugar industry for separating crystalline carbohydrates or sugar alcohols from a crystal suspension called a magma or a mother liquor, wherein the magma has a varying content of fine grain that is dependent on the properties of the pretreatment and of the raw material, with variable control values in a control device of the centrifuge, is hereby characterized in that one or a plurality of sensors are provided that carry out the measurements in electromagnetic, optical, acoustic, and/or conductive ways, in that these measurements that are conducted serve for determining the fine grain fraction of the magma, in that the measurements are supplied as measurement signals to the control device of the centrifuge, in that the control device automatically analyzes the measurement signals supplied to it and evaluates them with respect to the fine grain content of the magma, and in that the control device adjusts the variable control values of the centrifuge as a function of this evaluation, in that a regulation established in advance in the control routines is provided as follows:

filling the centrifuge with more than 50% and less than 70% of the maximum filling load;

adjusting the rotational speed of the centrifuge during filling to 150 to 200 rpm;

omitting the conventional syrup covering;

after filling, increasing the rotational speed with adjustable acceleration curves dependent on the time course and/or dependent on the viscosity and/or dependent on the fine grain content of the magma up to a predetermined or defined rotational speed;

adding a first water blanket (WB) or optionally a plurality of water blankets staggered in time during this increase in the rotational speed;

optional conducting of an intermediate centrifuging step;

in this case, adding another water blanket (WB);

increasing the rotational speed to a predetermined or defined rotational speed;

keeping this rotational speed constant for approximately 5 to 40 seconds;

throttling the rotational speed in the case of an established imbalance; subsequent repeated increasing of the rotational speed and, optionally, several repetitions of this step;

braking the centrifuge drum;

emptying the centrifuge drum; and conducting a screen washing.

25. A method for controlling the operation of a continuously or periodically operating centrifuge, which is employed in the sugar industry for separating crystalline carbohydrates or sugar alcohols from a crystal suspension called a magma or a mother liquor, wherein the magma has a varying content of fine grain that is dependent on the properties of the pretreatment and of the raw material, with variable control values in a control device of the centrifuge, is hereby characterized in that one or a plurality of sensors are provided that carry out the measurements in electromagnetic, optical, acoustic, and/or conductive ways, in that these measurements that are conducted serve for determining the fine grain fraction of the magma, in that the measurements are supplied as measurement signals to the control device of the centrifuge, in that the control device automatically analyzes the measurement signals supplied to it and evaluates them with respect to the fine grain content of the magma, and in that the control device adjusts the variable control values of the centrifuge as a function of this evaluation, in that a regulation established in advance in the control routines is provided as follows:

filling the centrifuge with more than 50% and less than 70% of the maximum filling load;

adjusting the rotational speed of the centrifuge during filling to 150 to 200 rpm;

omitting the conventional syrup covering;

after filling, linearly increasing the rotational speed up to 700 rpm;

adding a first water blanket (WB) during this linear increase in the rotational speed;

conducting an intermediate centrifuging step;

adding a second water blanket (WB);

increasing the rotational speed to 1,000 to 1,200 rpm;

keeping the rotational speed constant for approximately 15 to 40 seconds;

throttling the rotational speed in the case of an established imbalance;

subsequent repeated increase and, optionally, several repetitions of this step;

braking the centrifuge drum;

emptying the centrifuge drum; and conducting a screen washing.

* * * * *